United States Patent [19]

McKay

[11] 4,361,923

[45] Dec. 7, 1982

[54] LINT REMOVER

[75] Inventor: Nicholas D. McKay, Grand Blanc, Mich.

[73] Assignee: Helmac Products Corporation, Flint, Mich.

[21] Appl. No.: 290,786

[22] Filed: Aug. 6, 1981

[51] Int. Cl.[3] ..... A47L 25/00

[52] U.S. Cl. ..... 15/104 A; 15/230.11; 29/116 R

[58] Field of Search ..... 15/230, 230.11, 104 A; 29/116 R, 110

[56] References Cited

U.S. PATENT DOCUMENTS

| | | | |
|---|---|---|---|
| 2,401,842 | 6/1946 | Slater | 15/104 |
| 2,891,301 | 6/1959 | Conklin | 29/116 R |
| 3,421,170 | 1/1969 | Thomas, Jr. | 15/104 |
| 3,623,179 | 11/1971 | Roth | 15/104 A |
| 3,877,123 | 4/1975 | Pharris | 29/116 R |

*Primary Examiner*—Edward L. Roberts

*Attorney, Agent, or Firm*—Miller, Morriss and Pappas

[57] ABSTRACT

A lint remover assembly consisting of an elongate handle support member having an adhesive tape roll sleeve-engaging roller cylinder in rotatable snap-lock engagement therewith so that the roller cylinder is fixed against axial displacement with respect to the handle support member but is selectively rotatable thereon. An adhesive tape roll sleeve assembly provided for selective slidable frictional covering engagement with the roller cylinder so as to be rotatable therewith and selectively slidably removable therefrom for replacement upon exhaustion of the adhesive tape provided thereon. A cylindrical cover member provided for selective rotative lock engagement with the end of the handle support member so as to selectively cover the roller cylinder and the adhesive tape roll sleeve assembly positioned thereon without engaging the roller cylinder or otherwise interfering with the operation thereof.

8 Claims, 39 Drawing Figures

LINT REMOVER

This invention relates to a lint remover roller assembly comprising an elongate handle support member having an adhesive tape roll sleeve-engaging roller cylinder in rotatable snap-lock engagement therewith so that the roller cylinder is fixed against axial displacement with respect to the handle support member but is selectively rotatable thereon. An adhesive tape roll sleeve assembly is provided for selective slidable frictional covering engagement with the roller cylinder so as to be rotatable therewith and selectively slidably removable therefrom for replacement upon exhaustion of the adhesive tape provided thereon. A cylindrical cover member is provided for selective rotative lock engagement with the end of the handle support member so as to selectively cover the roller cylinder and the adhesive tape roll sleeve assembly positioned thereon without engaging the roller cylinder or otherwise interfering with the operation thereof.

The cover member is selectively locked in its covering position by a rotative locking engagement with locking means provided in the end of the handle means.

Once the roller cylinder is placed in its snap-locked use position on the handle support member, it is rotatable thereon but cannot be longitudinally moved in relation thereto or removed therefrom. Thus, the adhesive tape roll sleeves can be selectively slidably installed and removed from the roller cylinder by merely holding onto the handle support member. The lint remover is utilized by holding the handle member so that the outer adhesive surface of the adhesive tape roll sleeve positioned on the roller cylinder bears against the surface to be cleaned. The handle support member is selectively moved to cause the roller cylinder to roll over the surface being cleaned so that the adhesive tape engages and removes lint, dirt and other impurities from the surface being cleaned.

The lint remover devices of the prior art are generally comprised of a plurality of components that are difficult to assemble. Further, the relative complexity of such prior art devices has made it difficult to remove adhesive tape roll sleeves that have been fully used and replace them with new adhesive tape roll sleeves. Generally, such prior art lint remover devices have to be completely disassembled in order to replace their respective adhesive tape roll sleeves or cartridges.

A need has therefore existed for a lint remover assembly having a minimum of components so as to provide ease of assembly. Further, a need has existed for a lint remover assembly wherein the adhesive tape roll sleeves can be easily removed when the supply of tape is exhausted and replaced by a full adhesive tape roll sleeve without the need for fully or partially disassembling the lint remover assembly.

A need has also existed for a lint remover assembly having a cover member which is easily locked into its covering position on the lint remover assembly without engaging the adhesive tape roll sleeve or the roller cylinder member but which is lockably engaged and retained solely by the handle support member which extends axially through the cylinder roller member.

It is therefore an object of this invention to provide a lint remover assembly comprising an elongate integrally formed handle support member having an adhesive tape roll sleeve-engaging integrally formed roller cylinder member in rotatable snap-lcok engagement therewith.

Another object of this invention is to provide a lint remover assembly having a rotatable roller cylinder member which is adapted to slidably and replaceably receive an adhesive tape roll sleeve thereon.

Yet another object of this invention is to provide an easily assembled lint remover assembly which does not have to be partially or fully disassembled in order to replace an adhesive tape roll sleeve or cartridge thereon.

A still further object of this invention is to provide a lint remover assembly having a cover member which makes rotative locking engagement with the handle support member when placed in its covering position over the roller cylinder and adhesive tape roll sleeve positioned thereon.

Other objects and advantages found in the construction of the invention will be apparent from a consideration of the following specification in connection with the appended claims and the accompanying drawings.

IN THE DRAWINGS

DESCRIPTION

Figures 1, 2:
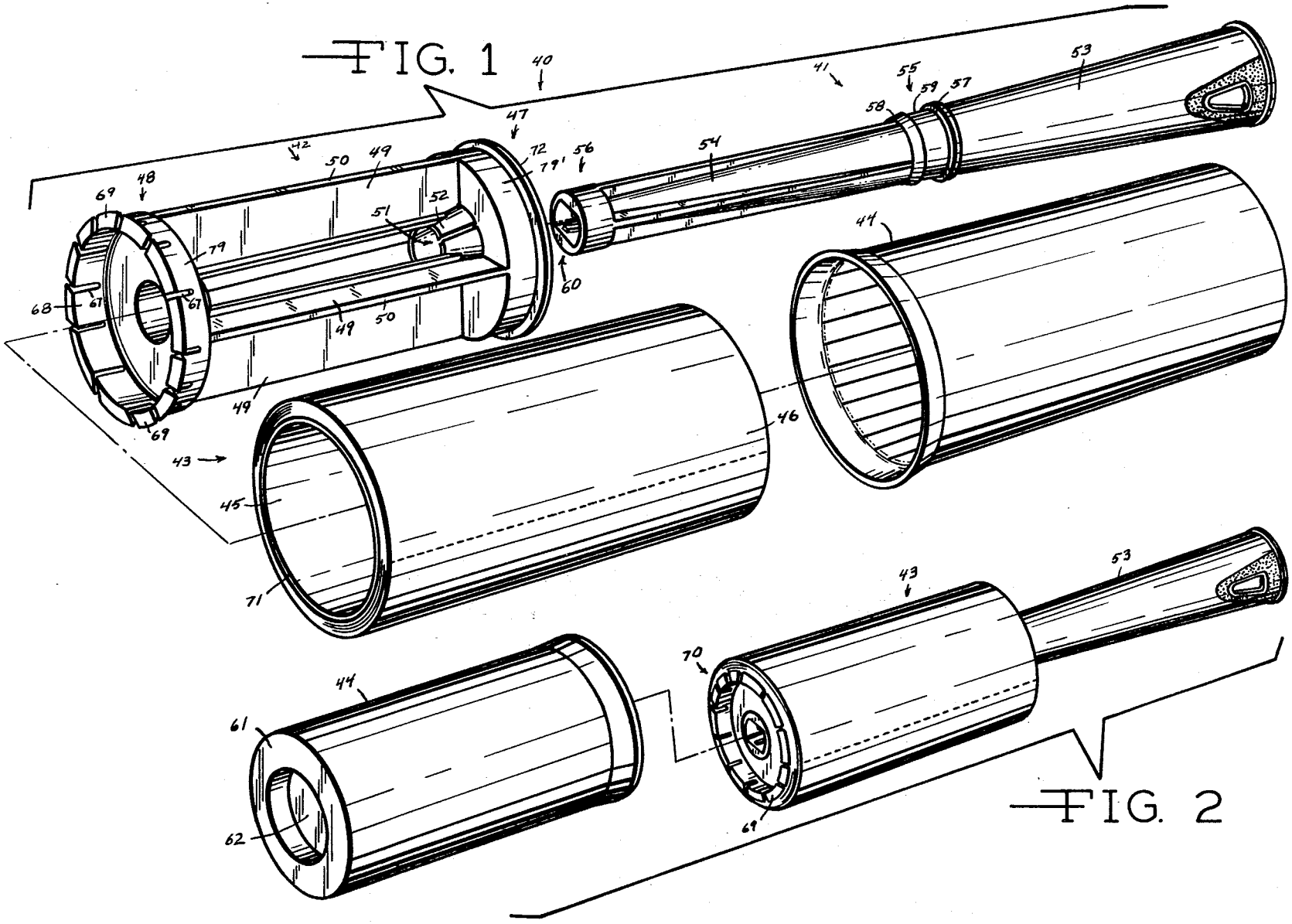
FIG. 1 is an exploded perspective view of the lint remover assembly showing the elongate handle support member, the integrally formed roller cylinder and the adhesive tape roll sleeve and cover member utilized therewith.
FIG. 2 is an exploded perspective view thereof showing the roller cylinder in rotatable snap-lock engagement with the handle member.

As shown in FIG. 1, the lint remover assembly 40 includes a handle support member 41 and a roller cylinder 42. An adhesive tape roll sleeve assembly 43 and a cylindrical cover member 44 are selectively utilized therewith as will be hereinafter described. The handle support member 41, roller cylinder 42 and cover 44 are each integrally molded from any desired type of plastic material.

The adhesive tape roll sleeve assembly 43 is comprised of a cardboard or plastic sleeve 45 having a supply of adhesive tape material 46 provided thereon. The adhesive tape material 46 is provided in perforated sections with the adhesive surface facing outwardly. In a manner well known in the prior art, the adhesive surface is rollably moved over the surface being cleaned and the lint particles, dirt and other impurities adhere thereto. When the outer adhesive tape surface becomes full of lint, the used section thereof is torn off so as to expose a new tape surface therebelow. This is repeated until the tape is completely used. The used adhesive tape roll sleeve assembly 43 is then slidably removed from the roller cylinder 42 and a full replacement adhesive tape roll sleeve 43 is placed thereon.

The integrally formed roller cylinder member 42 is comprised of a pair of opposed spaced-apart first and second circular end caps 47 and 48, respectively, which are fixedly interconnected by a plurality of radially disposed longitudinally extending tape roll sleeve-engaging support struts 49.

The outer longitudinal edge surfaces 50 of the support struts 49 are configured to slidably engage the inner surface of the adhesive tape roll sleeve 45 slidably positioned on the roller cylinder 42. Although the tape roll sleeve 45 is adapted for selective longitudinal slidable movement onto and off of the roller cylinder 42, the fit between the sleeve 45 and the roller cylinder 42 is such that, in use, there is no relative rotative movement therebetween, i.e. as the roller cylinder 42 rotates, the adhesive tape roll sleeve assembly 43 rotates therewith.

Figure 3:
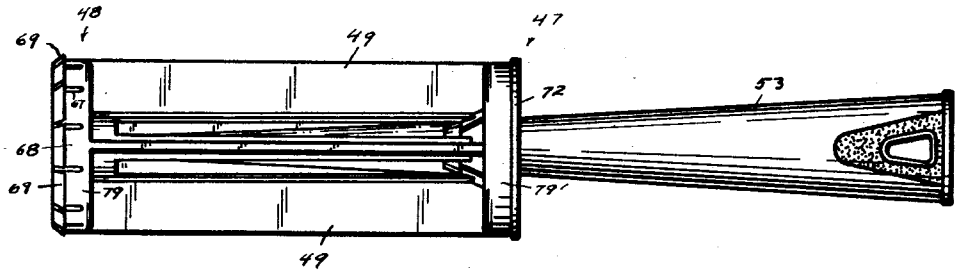
FIG. 3 is a side elevational view of handle portion with roller cylinder positioned thereon.
Figure 4:
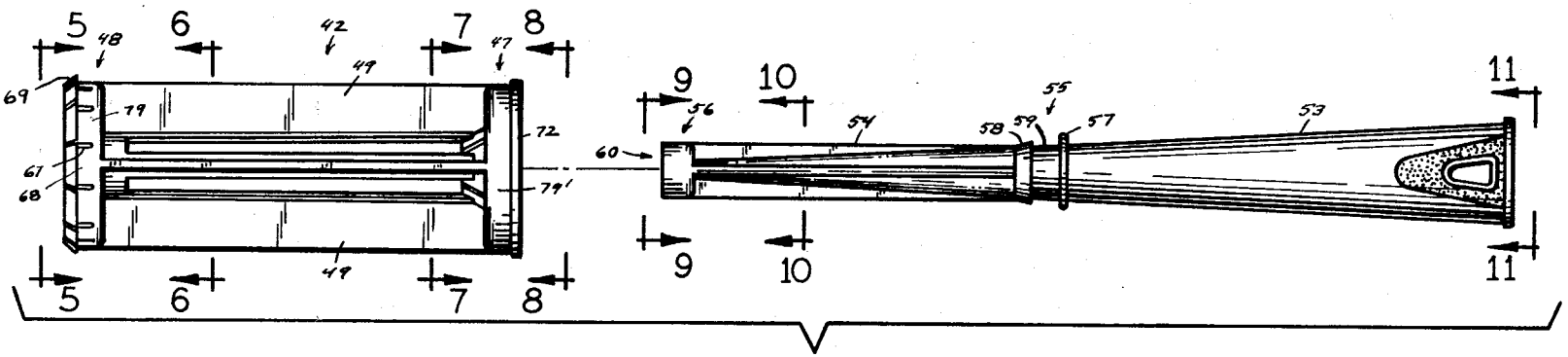
FIG. 4 is an exploded side elevational view thereof.
Figure 8:
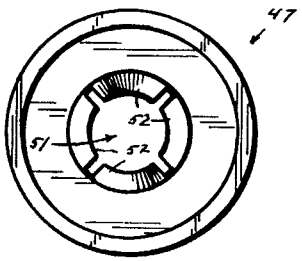
FIG. 8 is a right end view of the roller cylinder taken on line 8—8 of FIG. 4.
Figure 7:
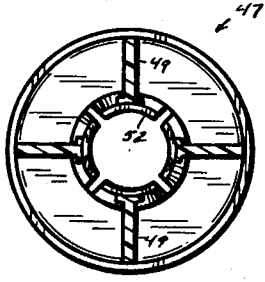
FIG. 7 is a cross-sectional view of the roller cylinder taken on line 7—7 of FIG. 4.
Figure 6:
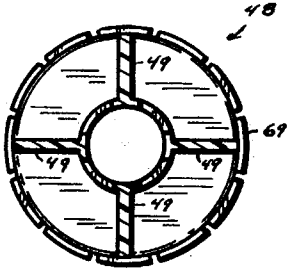
FIG. 6 is a cross-sectional view of roller cylinder taken on line 6—6 of FIG. 4.
Figure 5:
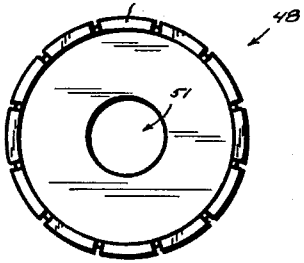
FIG. 5 is a left end view of the roller cylinder taken on line 5—5 of FIG. 4.
Figure 11:
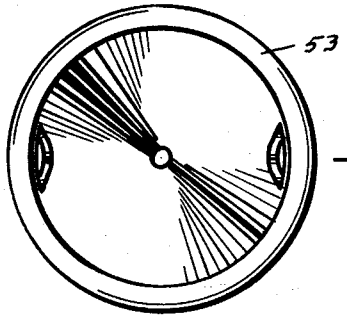
FIG. 11 is a right end view of the handle member taken on line 11—11 of FIG. 4.
Figure 19:
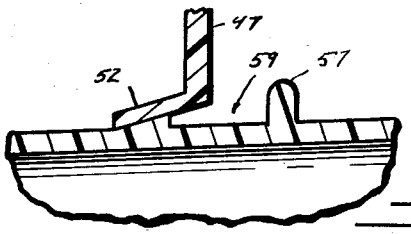
FIG. 19 is a partial schematic cross-sectional view of the roller-handle lock assembly in its pre-lock position and showing one of the resilient lock fingers provided at the end of the roller cylinder in engagement with the inclined annular lock ridge provided on the shaft portion of the handle member.
Figure 20:
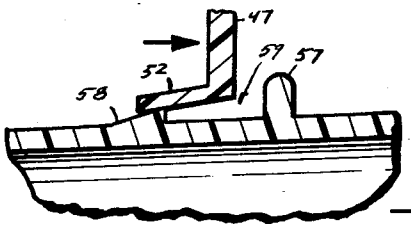
FIG. 20 is a partial schematic cross-sectional view of the roller-handle lock assembly in its transition position.
Figure 21:
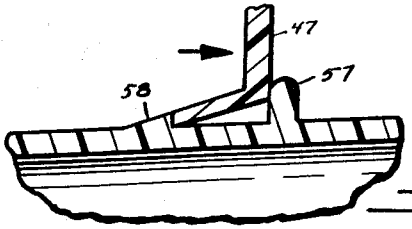
FIG. 21 is a partial schematic cross-sectional view of the roller cylinder-handle lock assembly in its lock position showing one of the lock fingers in its lock position in the annular lock-slot provided on the handle member.

The spaced-apart first end cap 47 and second end cap 48 are provided with central openings 51 therethrough which are in aligned register so as to receive the handle support member 41 therethrough. The first end cap 47 is provided with a plurality of radially disposed inwardly extending locking fingers 52 around the inner peripheral edge of the central opening 51 provided therethrough. The handle support member 41 consists of a handle portion 53 and an elongate roller cylinder member support shaft portion 54 extending longitudinally therefrom. The roller cylinder support shaft portion is provided with a central annular end cap engaging portion 55 and an outer annular end cap engaging portion 56 defined thereon. The central annular end cap engaging portion 55 comprises an annular stop flange 57 and a raised inclined locking ridge 58 spaced-apart therefrom to define an annular lock slot 59 therebetween. The annular lock slot 59 is adapted to lockably engage the locking fingers 52 on the first end cap 47 as the roller cylinder 42 is moved longitudinally into engagement with the support shaft portion 54 of the handle member 41 as shown in FIG. 3. This locking interaction is shown in the sequential schematic views of FIGS. 19, 20 and 21.

The outer end cap engaging portion 56 of the support shaft portion 54 of the handle member 41 is comprised of a cylindrical lock socket 60 having an outer annular surface adapted to be slidably and rotatably journalled at the inner surface of the central opening 51 defined in the second end cap 48 of the roller cylinder 42. The inner portion of the lock socket 60 is provided with cam lock surfaces adapted to lockably engage cam lock member provided on the internal surface of the end of the cover member 44 as will be hereinafter described. Thus positioned on the support shaft portion 54 of the handle member 41, the roller cylinder 42 is lockably retained on the handle member 41 and is restrained against longitudinal movement therealong and/or removal therefrom. The roller cylinder member 42 is selectively rotatable around the longitudinal axis of the support shaft portion 54 of the handle member 41. Thus positioned, roller cylinder member 42 is adapted to slidably receive an adhesive tape roll sleeve 43 longitudinally thereon. In use, the user grasps the handle 53 and moves the lint remover assembly 40 so as to roll the roller cylinder 42 and the adhesive tape roll sleeve assembly 43 mounted thereon against and across the surface to be cleaned. As the roller cylinder 42 and sleeve assembly 43 are rolled against the surface to be cleaned, the lint or other particles adhere to the lint remover tape surface and are thus removed from the surface being cleaned. As the tape surface becomes covered with lint or other impurities and looses its effectiveness, the outer section of tape is selectively removed so as to expose a clean surface therebelow. When the roll of tape is completely used, the tape roll sleeve 43 is slidably removed from the roller cylinder and a new replacement tape roll sleeve 43 is slidably positioned thereon with a full supply of lint removing adhesive tape.

Figure 13:
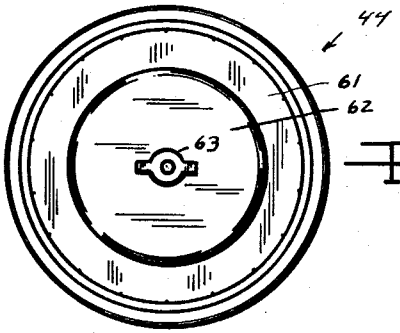
FIG. 13 is a right end view of the cover member showing the internal cam lock element provided on the internal surface of the end thereof.
Figure 15:
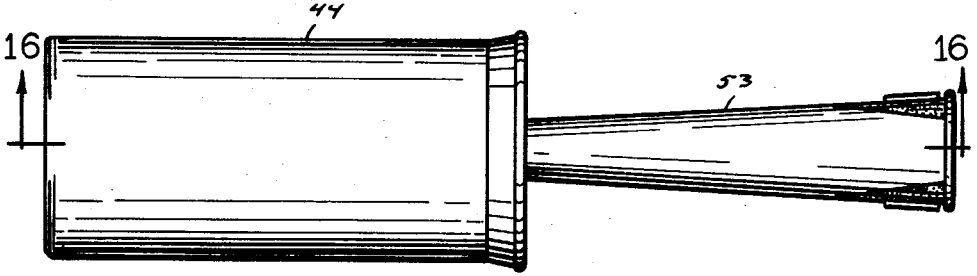
FIG. 15 is a side elevational view of the lint remover assembly showing the cover member in its operative use position thereon.
Figure 10:
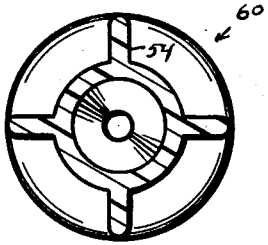
FIG. 10 is a cross-sectional view of the roller cylinder support shaft portion of the handle member taken on line 10—10 of FIG. 4.
Figure 9:
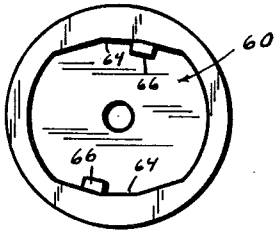
FIG. 9 is a left end view of the handle support member taken on line 9—9 of FIG. 4 and showing the cover-engaging cam lock socket provided on the end thereof.
Figure 12:
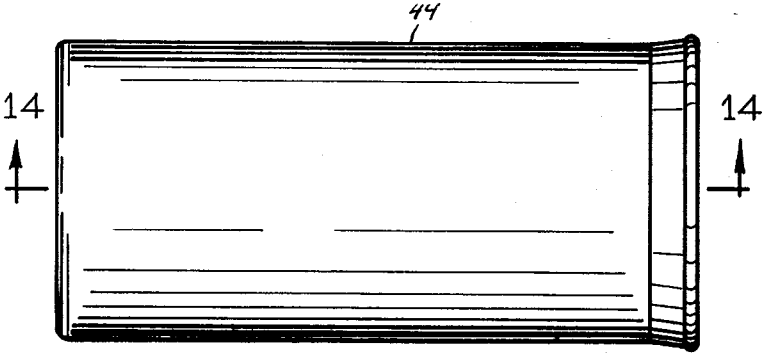
FIG. 12 is a side elevational view of the cover member.
Figure 14:
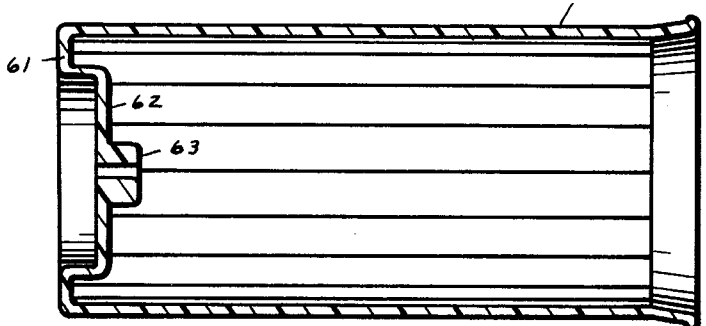
FIG. 14 is a cross-sectional view of the cover member taken on line 14—14 of FIG. 12.
Figure 16:
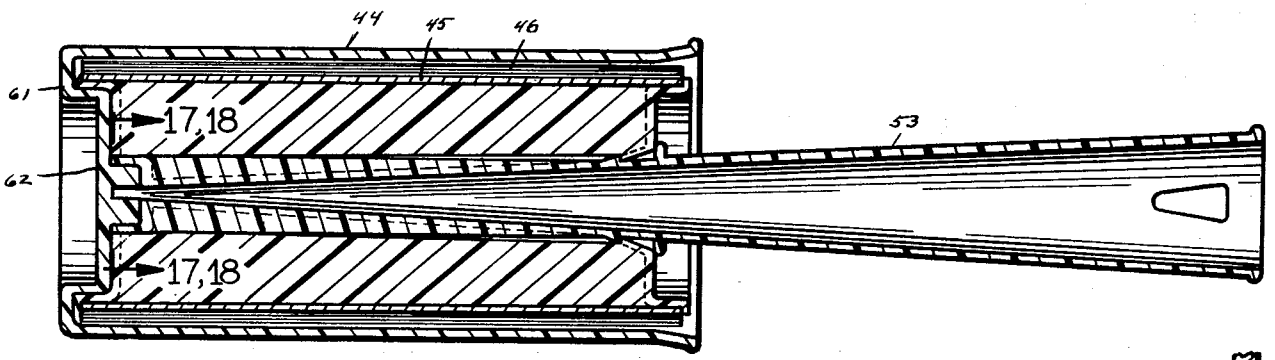
FIG. 16 is a cross-sectional view thereof taken on line 16—16 of FIG. 15.

As shown generally in the drawings and more specifically in FIGS. 1, 12, 13 and 14, the cover member 44 has a cylindrical tubular configuration and is closed at one end thereof. The closed end portion 61 is provided with a central inwardly depressed portion 62. As shown in FIG. 13, the inner surface of the depressed portion 62 is provided with a double wing inwardly extending cam element 63 which is adapted to extend into the socket portion 60 of the handle member 41 when the cover 44 is placed over the roller cylinder 42 as shown in FIG. 16.

Figure 18:
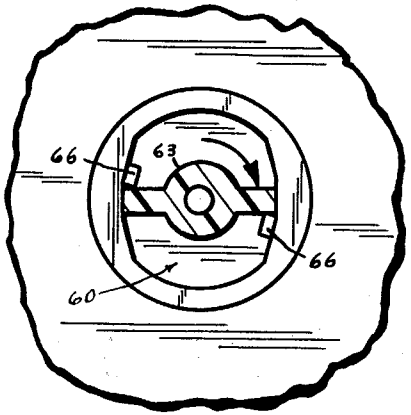
FIG. 18 is a partial cross-sectional view thereof in its lock position taken on line 18—18 of FIG. 18.
Figure 17:
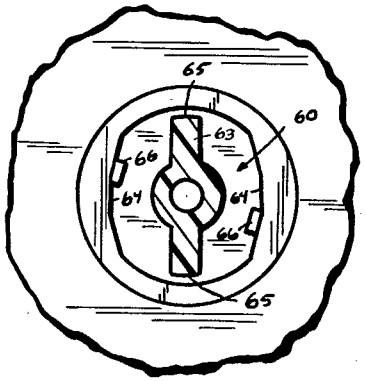
FIG. 17 is a partial cross-sectional view thereof taken on line 17—17 of FIG. 16 showing the cover cam lock element in its unlock position within the cover lock socket provided at the end of the handle member.
Figure 22:
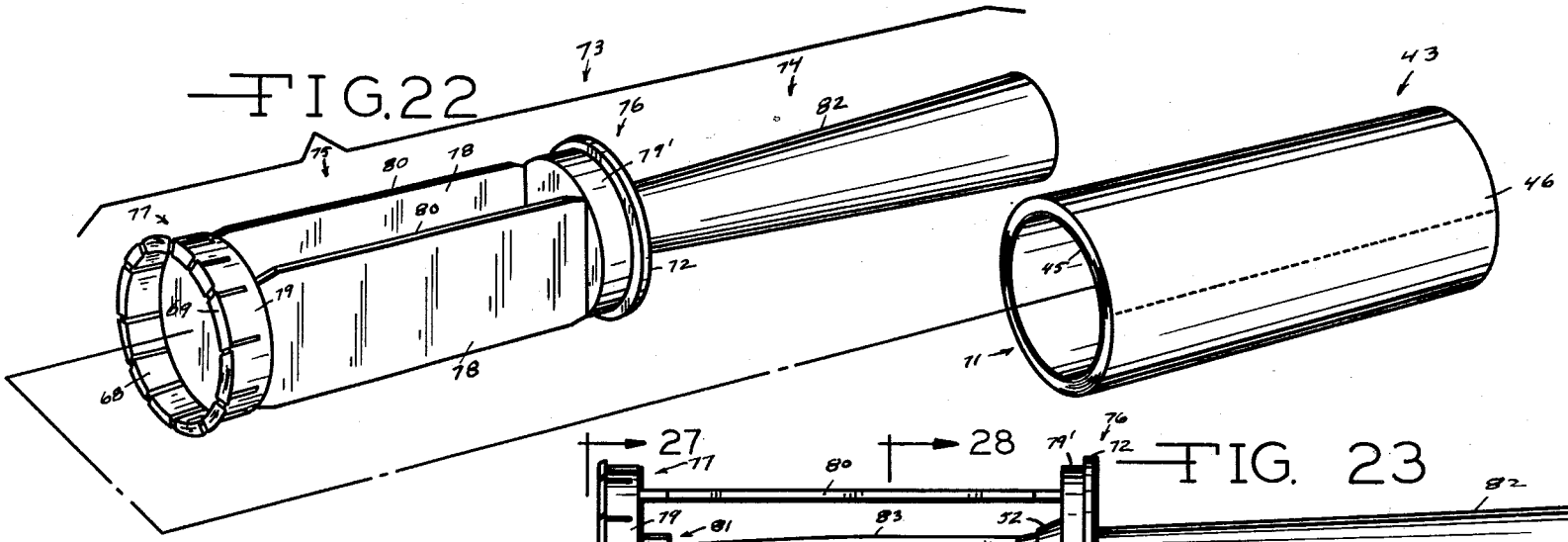
FIG. 22 is an exploded schematic perspective view of a lint remover showing a modified form of the roller cylinder utilizing a pair of longitudinally extending spaced-apart sleeve-engaging support struts integrally formed therein.

As shown in FIGS. 17 and 18, the lock socket 60 is provided with spaced-apart internal lock cam walls 64 which are adapted to lockably engage the ends 65 of the double wing cam element 63 provided in the cover 44.

As shown in FIG. 17, the double wing cam element 63 is in its unlock position within the elongated portion of the lock socket 60. As shown in FIG. 18, the cover can selectively be rotated approximately a quarter of a turn so that the ends 65 of the double wing cam element 63 move into forced locking engagement with the spaced-apart cam walls 64 of the socket 60. As further shown in FIG. 18, stop elements 66 are provided in the socket portion 60 which engage the ends of the double wing cam element 63 so as to prevent the cover 44 from continuing to rotate at an unlock position. The locking action occurs because the distance between the spaced-apart cam walls 84 is slightly less than the distance between the ends 65 of the double-wing cam element 63.

In order to unlock the cover element 44, it is selectively counter-rotated to the unlock position shown in FIG. 17. The cover 44 is then longitudinally pulled away out of covering engagement with the roller cylinder 42 as shown in FIG. 2.

It should be noted that although the preferred embodiment of the invention utilizes the foregoing cam lock arrangement for selective rotative locking engagement of the cover 44 with the handle 41, it is within the scope of the invention that there could be a threaded locking engagement of the cover 44 with the handle 41 whereby the double wing cam element 63 is replaced by a threaded bolt extension (not shown) which selectively engages a mating thread bore (not shown) provided in the lock socket portion 63. Any other equivalent lock means could also be utilized between the cover 44 and the socket 60 of the handle 41.

Figure 26:
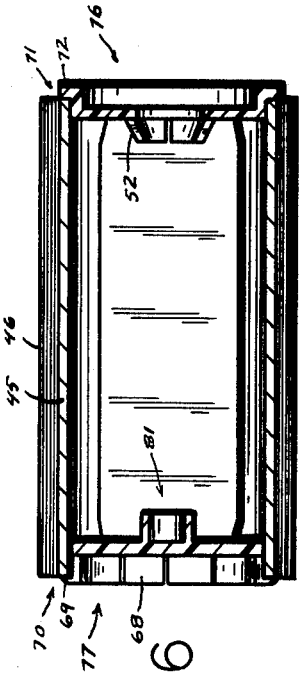
FIG. 26 is a full side cross-sectional schematic view of the roller cylinder shown in FIG. 25 with the adhesive tape roll sleeve positioned thereon.
Figure 29:
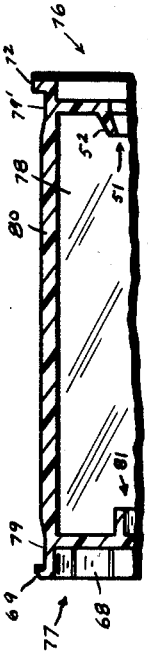
FIG. 29 is a partial cross-sectional view thereof taken on line 29—29 of FIG. 28.
Figure 31:
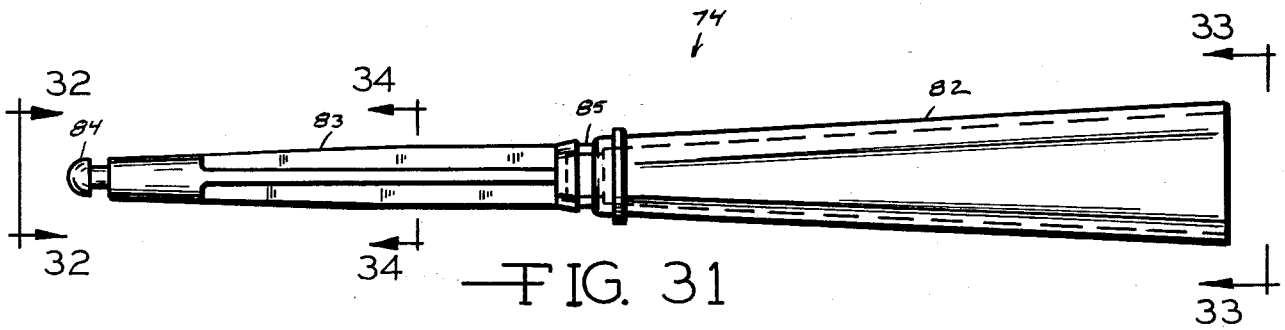
FIG. 31 is a side elevational view of the handle member as shown in FIG. 24.
Figure 33:
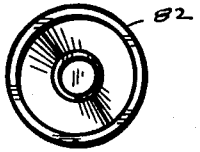
FIG. 33 is a right end view thereof taken on line 33—33 of FIG. 31.
Figure 32:
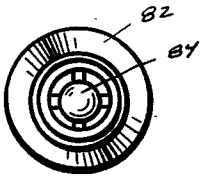
FIG. 32 is a left end view thereof taken on line 32—32 of FIG. 31.
Figure 34:
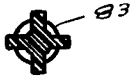
FIG. 34 is a cross-sectional view thereof taken on line 34—34 of FIG. 31.
Figure 35:
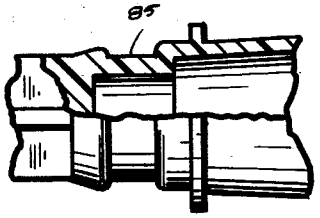
FIG. 35 is a partial schematic cross-sectional view of the central portion of the modified handle member showing the annular lock slot provided therein.
Figure 38:
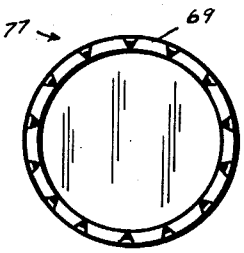
FIG. 38 is a left end view of another embodiment of the roller cylinder showing yet another type sleeve-retaining flange configuration.
Figure 37:
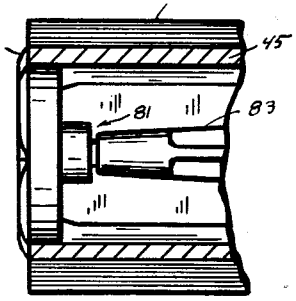
FIG. 37 is a partial schematic cross-sectional view of the modified embodiment of the roller cylinder shown in FIG. 36.
Figure 36:
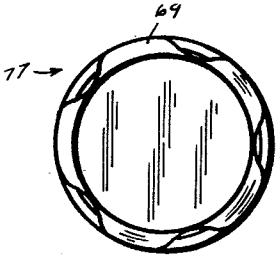
FIG. 36 is a left end view of another embodiment of the roller cylinder showing modified sleeve-retaining flanges provided along the outer peripheral edge thereof.
Figure 39:
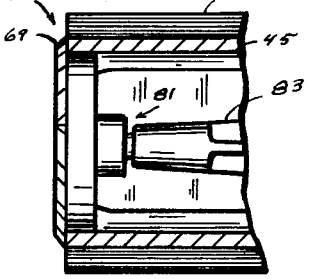
FIG. 39 is a partial schematic cross-sectional view of the embodiment of the roller cylinder shown in FIG. 38.

The outer circumferential edge of the second end cap portion 48 of the roller cylinder 42 is provided with spaced-apart longitudinally oriented slots 67 which divide the circumferential edge into a plurality of resilient fingers 68 that are provided with radially extending transverse flange elements 69 that are configured to retentatively engage the end portion 70 of the sleeve 43 mounted on the roller cylinder 42. This relationship is shown in FIG. 16 and also in the modified forms of the invention as shown in FIGS. 26, 37 and 39.

Figure 24:
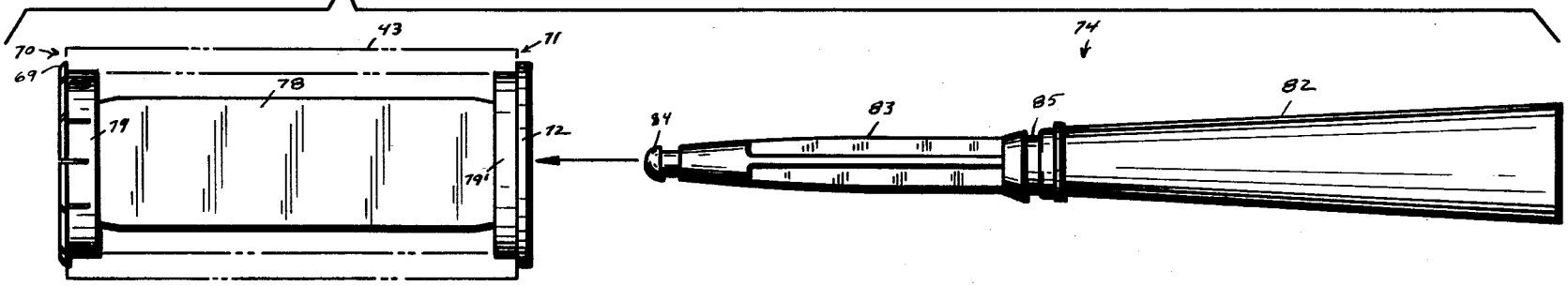
FIG. 24 is an exploded side elevational view of the modified form of the lint remover as shown in FIG. 22 with the adhesive tape roll sleeve shown in phantom-line.
Figure 27:
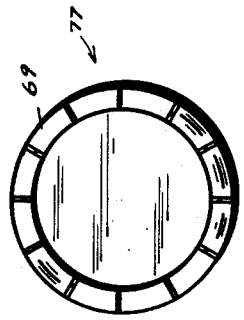
FIG. 27 is a left end view of the modified roller cylinder taken on line 27—27 of FIG. 23.
Figure 28:
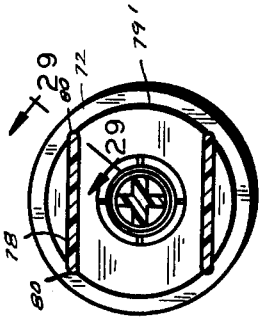
FIG. 28 is a cross-sectional view thereof taken on line 28—28 of FIG. 23.
Figure 30:
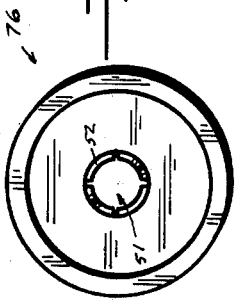
FIG. 30 is a right end view thereof taken on line 30—30 of FIG. 25.

In use, the resilient fingers 68 are biased radially inwardly as the adhesive tape roll sleeve assembly 43 is slidably longitudinally passed thereover into its operative use position on the roller cylinder 42. When the adhesive tape roll sleeve assembly 43 is in its operative use position on the roller cylinder 42, the end portion 71 of the sleeve 45 is in mating frictional engagement with the annular shoulder journal 78 of the end cap 47 and abuts the sleeve-retaining annular flange 72 provided on the end cap 47 of the roller cylinder 42. With the sleeve assembly 43 thus positioned, the opposite outer end 70 of the sleeve 45 is retainably engaged by the flange elements 69 provided on the resilient fingers 68 which have sprung back into their normal use position after the sleeve assembly 43 has moved into its operative use on the roller cylinder 42 as shown in FIGS. 16 and 24.

It should be noted that the preferred embodiment of the roller cylinder 42 is provided with four equally spaced-apart radially disposed longitudinal support struts 49 which are integrally formed with and support the spaced-apart end caps 47 and 48 to form the roller cylinder 42. However, it is considered to be within the scope of the invention to utilize any number or configuration of support struts to form the roller cylinder 42. Further, it is also considered to be within the scope of the invention to utilize a cylindrical tubular member (not shown) to fixedly engage and support the end caps 47 and 48 in their spaced-apart operative use position so as to integrally form the roller cylinder 42. The outer surface of such cylindrical tubular member would be adapted to slidably frictionally engage and support the adhesive tape roll sleeve assembly 43 in its operative use position thereon.

A modified embodiment of the invention is shown in FIGS. 22 through 39. The modified lint remover assembly 73 comprises a handle support member 74 and a roller cylinder member 75 which is adapted to slidably and supportably receive an adhesive tape roll sleeve assembly 43 thereon as shown in phantom-line in FIG. 24.

The roller cylinder 75 of the modified embodiment of the invention is comprised of a pair of opposed spaced-apart first inner and second outer circular end caps 76 and 77, respectively, which are fixedly interconnected by a pair of spaced-apart longitudinally extending adhesive tape roll sleeve-engaging support struts 78. As in the case of corresponding end caps 47 and 48 of the roller cylinder 42 of the preferred embodiment of the invention, the end caps 76 and 77 are provided annular shoulder journal portions 79' and 79, respectively, which are adapted to frictionally supportably engage the inner surface of the end portions of the adhesive tape roll sleeve 45 positioned thereon as shown in phantom-line in FIG. 24. Further, as in the case of the support struts 49, the outer edge surfaces 80 of the support struts 78 are positioned so as to frictionally engage the inner surface of the adhesive tape roll sleeve 45.

Figure 23:
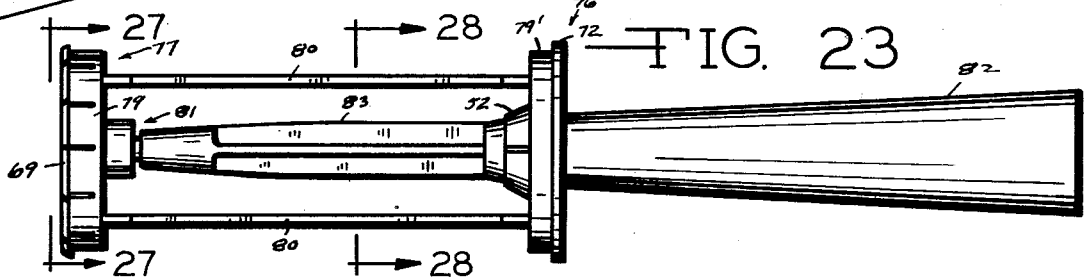
FIG. 23 is a top view of the modified form of the lint remover shown in FIG. 22.
Figure 25:
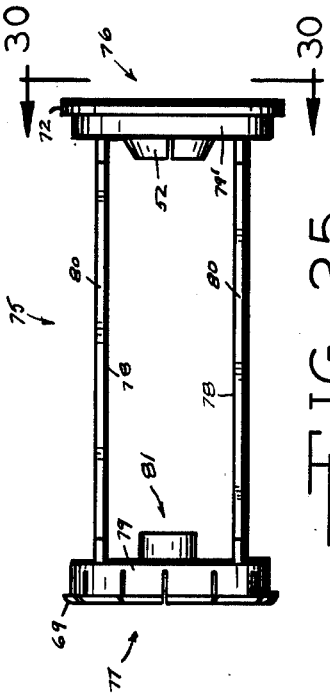
FIG. 25 is a top view of the roller cylinder shown in FIG. 24.

As shown in FIGS. 25, 26 and 23, the inner end cap 76 is identical to the end cap 47 of the preferred embodiment of the invention in that it is provided with a central opening 51 having a plurality of resilient locking fingers 52 extending radially inward from the inner peripheral edge thereof. However, the second end cap 77 of the modified embodiment of the lint remover has no central opening therethrough, but is provided with an inwardly directed axially positioned socket journal 81 thereon, as shown in FIGS. 25 and 26. The modified outer end cap 77 is also provided with a plurality of longitudinally extending resilient fingers 68 having flange elements 69 that retainably engage the end portion 70 of the sleeve 45 of the adhesive tape roll assembly 43.

The handle support member 74 of modified embodiment of the lint remover 73 consists of a handle portion 82 and a roller cylinder support shaft portion 83. The end of the support shaft 83 is provided with a bearing extension 84 which is configured to be selectively freely positioned in bearing engagement within the socket journal 81 when the roller cylinder 75 is selectively positioned on the shaft portion 83 of the handle support member 74 as shown in FIGS. 23, 37 and 39. The central portion of the handle support member 74 is provided with an annular lock slot 85 which is adapted to lockably engage the locking fingers 52 as previously described and as shown in FIG. 23 and in the locking sequence shown in FIGS. 19, 20 and 21. Thus positioned, the roller cylinder 75 cannot be removed from the handle support member 74 or otherwise moved axially with respect thereto. However, the roller cylinder 75 is freely rotatable on the support shaft 83. The modified lint remover assembly 73 operates in the same manner as the previously described preferred embodiment of the invention whereby an adhesive tape roll sleeve assembly is selectively frictionally positioned on the roller cylinder and is rotatable therewith over a surface so as to remove lint, dirt or other impurities therefrom. Other configurations of sleeve retaining flanges 86 and 87 are provided on the end caps 76 and shown in FIGS. 36 and 37, respectively.

It is thus seen that a lint remover assembly is provided which consists of an elongate handle support member. The handle support member comprises a handle portion and a roller cylinder-engaging shaft portion extending axially from the handle portion. The handle support member is provided with a central locking finger-engaging annular lock slot. The roller cylinder-engaging shaft portion is provided with an outer roller cylinder-engaging cover lock socket at the end thereof. An adhesive tape roll sleeve-engaging roller cylinder is provided for selective snap lock engagement with the shaft portion so as to be fixed against axial displacement with respect thereto. The adhesive tape roll sleeve-engaging roller cylinder is rotatably journaled on the annular lock slot and the outer annular surface of the outer roller cylinder-engaging cover lock socket so as to be selectively rotatable around the shaft portion. An adhesive tape roll sleeve assembly is provided for selective axially slidable frictional covering engagement with the roller cylinder. A cylindrical tubular cover member having a closed end portion is provided for rotative selective locking engagement with the shaft portion of the handle support member so as to cover the adhesive tape roll sleeve assembly positioned on the roller cylinder. The cover member is provided with centrally positioned inwardly extending cam lock means on the inner surface of the closed end thereof. The cam lock means are adapted to selectively extend into the cover lock socket of the shaft portion of the handle support member when the cover member is in a covering relationship with the adhesive tape roll assembly. The cam lock means are adapted to make selective locking engagement with the lock socket upon selective rotation of the cover member so as to lockably retain the cover member in its covering position over the adhesive tape roll sleeve assembly positioned on the roller cylinder. The roller cylinder includes a first inner adhesive tape roll sleeve-engaging circular end cap and a second outer adhesive tape roll sleeve engaging circular end cap. The first inner end cap and the second outer end cap are fixedly interconnected in an opposed axially aligned spaced-apart relationship by integrally formed adhesive tape roll sleeve-engaging support means so as to provide said integrally formed roller cylinder. The first inner end cap defines a first central opening therethrough having a plurality of resilient inwardly extending locking fingers along the inner peripheral edge thereof. The resilient locking fingers are adapted to make snap locking engagement with the annular lock slot provided on the shaft portion of the handle support member so as to fix the roller cylinder against axial displacement with respect thereto while permitting selective rotative movement thereof upon the shaft portion. The second outer end cap defines a second central opening therethrough. The second outer end cap central opening is in aligned register with the first central opening of the first inner end cap. The second central opening is adapted to selectively journally support the outer roller cylinder-engaging cover lock socket therein so as to rotatably support the roller cylinder upon the shaft portion of the handle support member. The adhesive tape roll sleeve assembly includes a hollow sleeve member. The hollow sleeve member is provided with a lint removing adhesive tape roll positioned thereon. The integrally formed adhesive tape roll sleeve-engaging support means forming the roller cylinder comprise a plurality of radially disposed longitudinally extending support struts having outer edge surfaces adapted to frictionally engage the inner surface of the adhesive tape roll sleeve assembly. The outer circumferential edge of the second outer end cap is provided with a plurality of longitudinally outwardly extending resilient fingers having radially extending flange elements. The flange elements are adapted to retainably engage the end of the adhesive tape roll assembly provided on the roller cylinder.

In summary, a highly utilitarian lint remover assembly is provided which, once assembled, does not have to be fully or partially disassembled to replace the adhesive tape roll sleeve positioned thereon. Further, the cover member utilized therewith is adapted to rotatably lockably engage the handle portion so as to be in covering relationship with the roller cylinder upon which the adhesive tape roll sleeve assembly is mounted, but the cover does not engage or otherwise interfere with the roller cylinder assembly.

Various other modifications of the invention may be made without departing from the principle thereof. Each of the modifications is to be considered as included in the hereinafter appended claims, unless these claims by their language expressly provide otherwise.

I claim:

1. In a lint remover assembly, the combination comprising:

an elongate handle support member, said handle support member having a handle portion and a roller cylinder-engaging shaft portion extending axially from said handle portion, said handle support member provided with a central locking finger-engaging annular lock slot, said roller cylinder-engaging shaft portion provided with an outer roller cylinder-engaging cover lock socket at the end thereof for locking engagement with a cover member; and an adhesive tape roll sleeve-engaging roller cylinder provided for selective snap lock engagement with said shaft portion so as to be fixed against axial displacement with respect thereto, said adhesive tape roll sleeve-engaging roller cylinder rotatably journaled on said annular lock slot and the outer annular surface of said outer roller cylinder-engaging cover lock socket so as to be selectively rotatable around said shaft portion.

2. In the lint remover assembly of claim 1 wherein an adhesive tape roll sleeve assembly is provided for selective axially slidable frictional covering engagement with said roller cylinder.

3. In the lint remover assembly of claim 2 wherein a cylindrical tubular cover member having a closed end portion is provided for rotative selective locking engagement with said shaft portion of said handle support member so as to cover said adhesive tape roll sleeve assembly positioned on said roller cylinder.

4. In the lint remover assembly of claim 3 wherein said cover member is provided with centrally positioned inwardly extending cam lock means on the inner surface of said closed end thereof, said cam lock means are adapted to selectively extend into said cover lock socket of said shaft portion of said handle support member when said cover member is in a covering relationship with said adhesive tape roll assembly, said cam lock means adapted to make selective locking engagement with said lock socket upon selective rotation of said cover member so as to lockably retain said cover member in its covering position over said adhesive tape roll sleeve assembly positioned on said roller cylinder.

5. In the lint remover assembly of claim 1 wherein said roller cylinder includes a first inner adhesive tape roll sleeve-engaging circular end cap and a second outer adhesive tape roll sleeve engaging circular end cap, said first inner end cap and said second outer end cap fixedly interconnected in an opposed axially aligned spaced-apart relationship by integrally formed adhesive tape roll sleeve-engaging support means so as to provide said integrally formed roller cylinder, said first inner end cap defining a first central opening therethrough having a plurality of resilient inwardly extending locking fingers along the inner peripheral edge thereof, said resilient locking fingers adapted to make snap locking engagement with said annular lock slot provided on said shaft portion of said handle support member so as to fix said roller cylinder against axial displacement with respect thereto while permitting selective rotative movement thereof upon said shaft portion, said second outer end cap defining a second central opening therethrough, said second outer end cap central opening being in aligned register with said first central opening of said first inner end cap, said second central opening adapted to selectively journally support said outer roller cylinder-engaging cover lock socket therein so as to rotatably support said roller cylinder upon the shaft portion of said handle support member.

6. In the lint remover assembly of claim 2 wherein said adhesive tape roll sleeve assembly includes a hollow sleeve member, said hollow sleeve member provided with a lint removing adhesive tape roll positioned thereon.

7. In the lint remover assembly of claim 5 wherein said integrally formed adhesive tape roll sleeve-engaging support means forming said roller cylinder comprise a plurality of radially disposed longitudinally extending support struts having outer edge surfaces adapted to frictionally engage the inner surface of said adhesive tape roll sleeve assembly.

8. In the lint remover assembly of claim 7 wherein the outer circumferential edge of said second outer end cap is provided with a plurality of longitudinally outwardly extending resilient fingers having radially extending flange elements, said flange elements adapted to retainably engage the end of said adhesive tape roll assembly provided on said roller cylinder.

* * * * *